US006047553A

United States Patent [19]

Germain

[11] Patent Number: 6,047,553

[45] Date of Patent: Apr. 11, 2000

[54] APPARATUS AND CRYOGENIC VALVE FOR THE DELIVERY OF A CRYOGENIC LIQUID, AND CORRESPONDING PLANT FOR PACKAGING A PRODUCT

[75] Inventor: Jean-Pierre Germain, Montigny le Bretonneux, France

[73] Assignee: L'Air Liquide Société Anonyme pour l'Etude et l'Exploitation des Procédés Georges Claude, Paris, France

[21] Appl. No.: 09/110,971

[22] Filed: Jul. 7, 1998

[30] Foreign Application Priority Data

Jul. 7, 1997 [FR] France ..... 97 08588

[51] Int. Cl.[7] ..... F17C 7/02; F17C 9/02

[52] U.S. Cl. ..... 62/50.1; 62/50.5; 62/50.7

[58] Field of Search ..... 62/50.1, 50.7, 62/50.5

[56] References Cited

U.S. PATENT DOCUMENTS

| | | | |
|---|---|---|---|
| 4,506,512 | 3/1985 | Delacour et al. . | |
| 4,546,609 | 10/1985 | Roullet et al. . | |
| 5,218,827 | 6/1993 | Pevzner | 62/50.6 |
| 5,400,601 | 3/1995 | Germain et al. | 62/50.1 |
| 5,477,691 | 12/1995 | White | 62/50.2 |

FOREIGN PATENT DOCUMENTS

| | | |
|---|---|---|
| 0364009 | 4/1990 | European Pat. Off. . |
| 364009 | 4/1990 | European Pat. Off. . |
| 2539211 | 7/1984 | France . |
| 2547017 | 12/1984 | France . |

*Primary Examiner*—William Doerrler

*Attorney, Agent, or Firm*—Nixon Peabody LLP; Robert M. Schulman

[57] ABSTRACT

Apparatus for delivering a cryogenic liquid comprising a thermally insulated main pipe in which a device for throttling a flow of liquid is mounted, a degassing pipe which is tapped off the upper part of the main pipe downstream of the throttling device.

7 Claims, 2 Drawing Sheets

APPARATUS AND CRYOGENIC VALVE FOR THE DELIVERY OF A CRYOGENIC LIQUID, AND CORRESPONDING PLANT FOR PACKAGING A PRODUCT

BACKGROUND OF THE INVENTION (i) Field of the Invention

The present invention relates to an apparatus for delivering a cryogenic liquid, of the type comprising a thermally insulated main pipe in which a device for throttling the flow of liquid is mounted.

It applies particularly to the controlled delivery of liquid nitrogen to moving containers, for the purpose of inerting them and/or of pressurizing them.

(ii) Description of the Related Art

As is well known, the inevitable heat influx into pipes conveying cryogenic liquids causes the appearance of bubbles in these liquids, making it difficult to transfer them at a constant flow rate, especially for flow rates of less than 10 l/h.

One situation particularly sensitive to this phenomenon is encountered in the process of pressurizing cans using liquid nitrogen. In this technique, a row of cans in contact with each other, after they have been filled with a noncarbonated product, for example a still drink, move along beneath a nozzle from which a thin stream of liquid nitrogen flows. Each can thus receive a few drops of liquid nitrogen and is then hermetically sealed.

The start of vaporization of the nitrogen, before the can is sealed, expels the air from the can, thus ensuring that the product is inerted. Next, after the can has been sealed, the end of vaporization of the nitrogen pressurizes the can, thereby allowing it to be handled as desired without the risk of it being dented or crushed.

As will have been understood, if the quantity of liquid nitrogen received by a can is too low, the pressurization will be insufficient to maintain the integrity of the can, and if this quantity is too great there is a risk of the can exploding.

Current filling systems make several tens of cans per second move along in a single line, and increasingly high rates are envisaged. Furthermore, if one takes into account the periods of acceleration and braking of the systems during the start and stop phases of the plant, it will be understood that a very precise control of the liquid nitrogen flow rate dispensed at each instant is critical for the development of the process.

SUMMARY OF THE INVENTION

The object of the invention is to be able to control the flow of cryogenic liquid better. For this purpose, the subject of the invention is an apparatus of the aforementioned type, characterized in that it comprises a degassing pipe which is tapped off the main pipe downstream of the throttling device.

The apparatus according to the invention may include one or more of the following characteristics:

the degassing pipe is tapped off the upper part of the main pipe;

the throttling device is the closure member of a valve which comprises a valve body defining an upstream intermediate section and a downstream intermediate section of the main pipe, as well as a seat located between these two sections, the closure member being mounted so as to move in the body with respect to the seat, and the valve body is provided with a hole which emerges in the upper part of the downstream intermediate section and which is connected to the degassing pipe;

the degassing pipe extends within the outer wall of the main pipe;

the apparatus furthermore comprises a cryogenic liquid reservoir, from the bottom of which the main pipe starts, and the degassing pipe emerges in the upper part of this reservoir.

The subject of the invention is also a cryogenic valve for such an apparatus. This cryogenic valve, of the type comprising a valve body which defines an upstream duct section, a downstream duct section, as well as a seat located between these two sections, and a closure member mounted so as to move in the body with respect to the seat, is characterized in that the valve body is provided with a hole which emerges in the upper part of the downstream section.

In one embodiment of this valve, the seat is frustoconical and downwardly convergent and is extended downward by a cavity, and the closure member comprises a frustoconical part conjugate with the seat and a lower part designed to be housed with a certain clearance in said cavity when the closure member is in the closed position.

The subject of the invention is also a plant for packaging a product in moving containers, comprising an apparatus for delivering liquid nitrogen, as defined above, placed above the conveyor for the containers, between a station for filling the containers with the product and a station for sealing the containers.

BRIEF DESCRIPTION OF THE DRAWINGS

An embodiment of the invention will now be described with regard to the appended drawings, in which.

DESCRIPTION OF THE PREFERRED EMBODIMENT

Figures 1, 2:
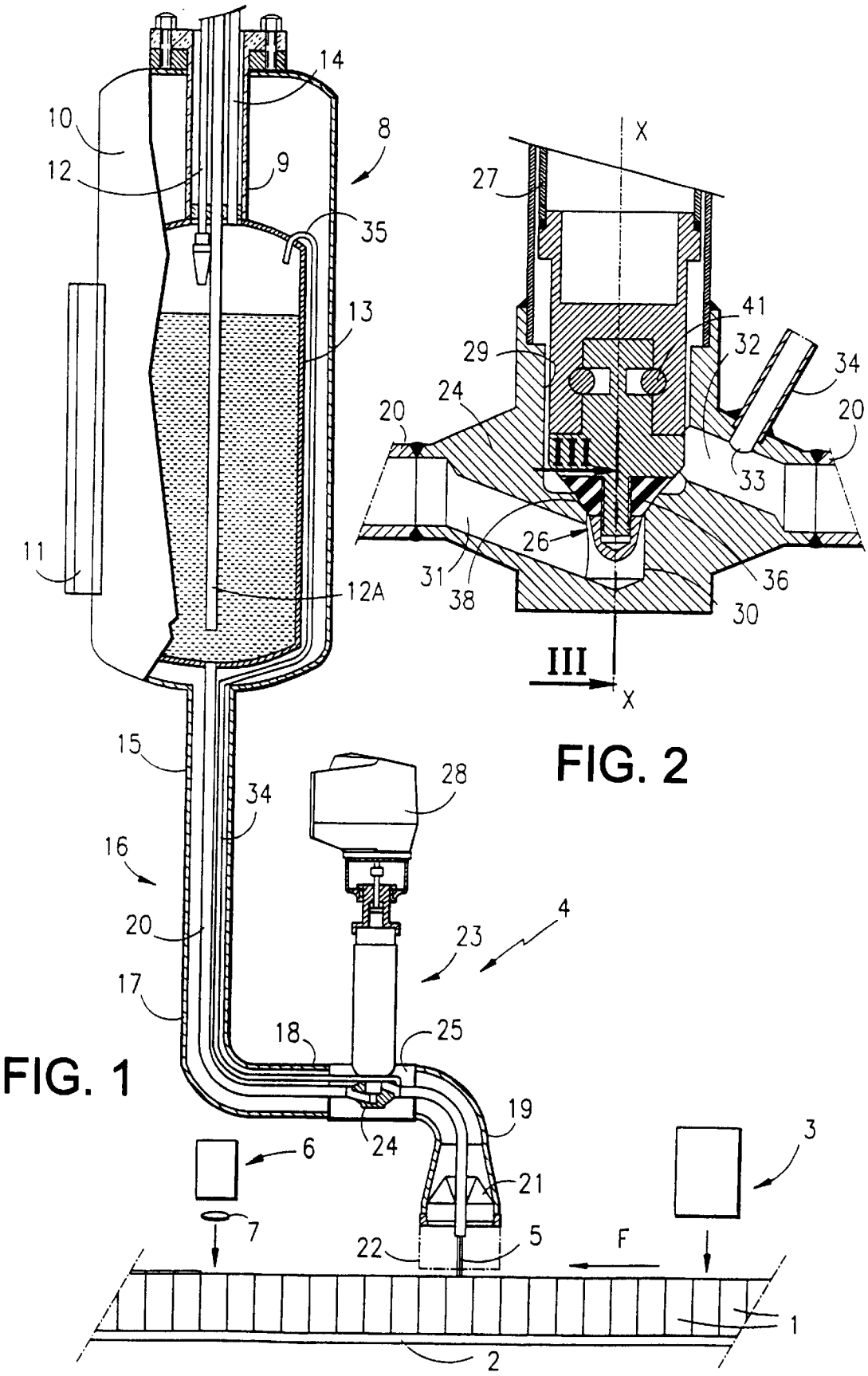
FIG. 1 illustrates diagrammatically, in partial cross section, a packaging plant according to the invention.
FIG. 2 illustrates, in cross section, on a larger scale, the valve for controlling the plant shown in FIG. 1.

FIG. 1 illustrates diagrammatically a plant for packaging a noncarbonated liquid product in a row of contiguous cylindrical cans 1. These cans are carried by a conveyor 2 and move along successively, in the direction of the arrow F, beneath a station 3 for filling the cans with the product, beneath an apparatus 4 for delivering a stream 5 of liquid nitrogen and beneath a station 6 for crimping a sealing lid 7.

The stations 3 and 6 are conventional, so that only the apparatus 4 will be described below.

The apparatus 4 comprises, from the upstream end to the downstream end, a double-walled liquid nitrogen reservoir 8, the upper openings in the two walls being connected by a thermally insulating neck 9. The outer wall 10 is equipped with a structure 11 for fixing the reservoir to a suitable support (not illustrated). The neck 9 is penetrated by a supply pipe 12 controlled by a sensor 12A which detects the liquid nitrogen level in the inner wall 13 of the reservoir, and by a degassing pipe 14 which emerges in the surrounding atmosphere. The reservoir is furthermore equipped with various conventional accessories (not illustrated).

The bottom of the wall 10 has a hole from which the outer wall 15 of a main pipe 16 for delivering liquid nitrogen starts. This pipe consists of a first section 17 extending vertically downward, a horizontal second section 18 and a third section 19 extending vertically downward.

Likewise, the inner tube 20 of the pipe 16 starts from the bottom of the inner wall 13 of the reservoir, said inner tube 20 extending coaxially along the entire length of the wall 15. At the downstream end of the pipe, a closure device 21 is provided between the wall 15 and the tube 20. The inter-wall space in the pipe 16 as well as that in the reservoir 8, which communicates with the latter, are thermally insulated under vacuum in a conventional manner.

Optionally, as illustrated by the dot-dash lines in FIG. 1, an interchangeable liquid nitrogen dispensing head 22 is provided on the downstream end of the pipe 16.

A control valve 23 is mounted in the horizontal section 18. This valve (FIGS. 1 and 2) essentially comprises a valve body 24 surrounded by a thermal insulation 25, a closure member 26, actuated by a vertical control rod 27, and an actuator 28 located at the upper end of the rod 27.

Figure 3:
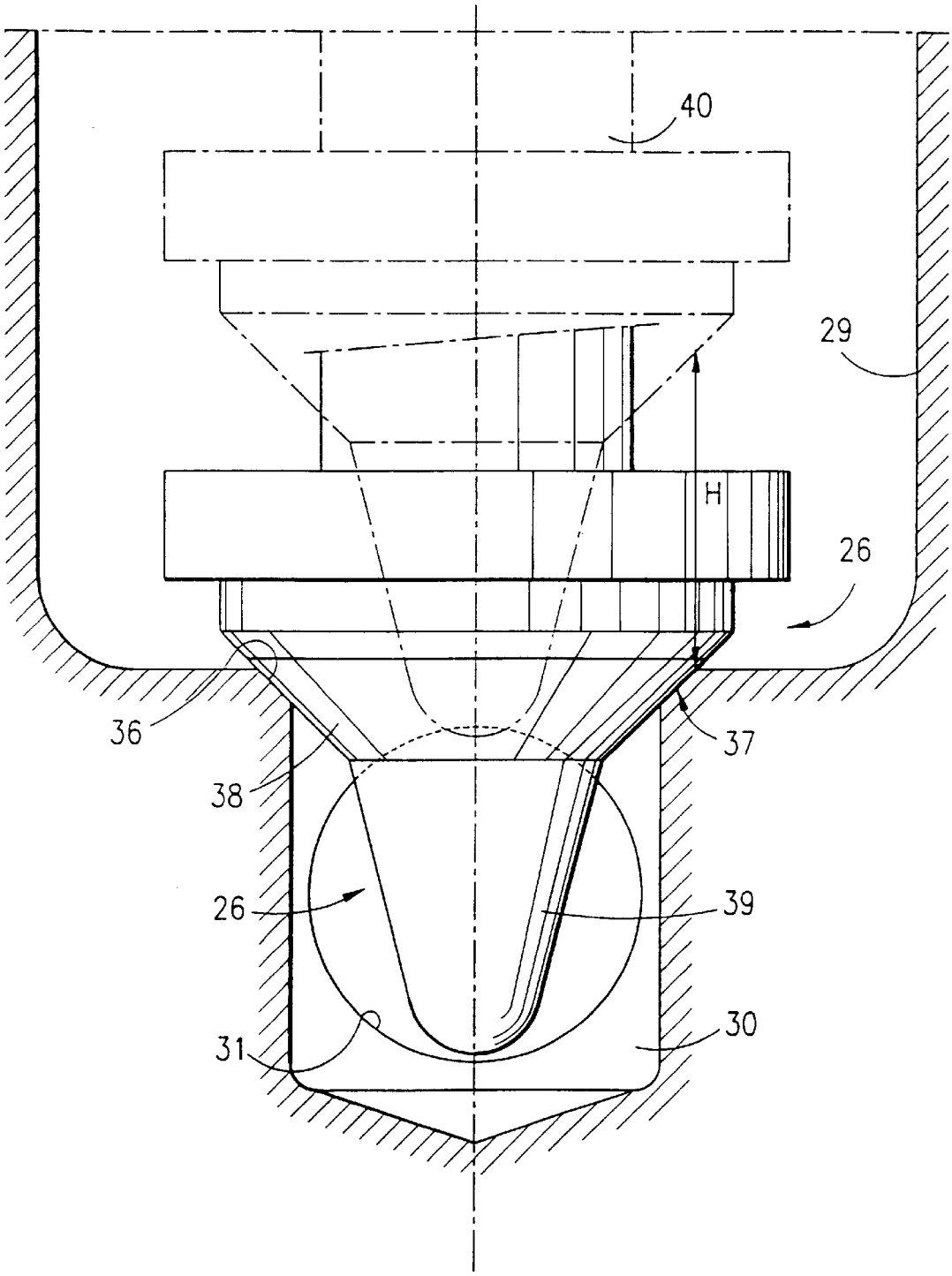
FIG. 3 illustrates diagrammatically, on an even larger scale, a detail of this valve.

As may be more clearly seen in FIG. 2, the valve body 24 has, starting from its upper face, a vertical bore 29 extended downward by a blind counterbore of the same axis X—X, which defines a cylindrical cavity 30. An upstream duct section 31, inclined downward, starts from a lateral face of the valve body and emerges in the cavity 30. Its diameter is slightly less than that of the counterbore (FIG. 3). A downstream duct section 32, inclined downward in the same way as the section 31, starts from the bore 29 and emerges in the opposite lateral face of the valve body. When the valve is in the open position, the duct sections 31 and 32, as well as the space which connects them, may be regarded as forming part of the main pipe 16, the sections 31 and 32 forming upstream and downstream intermediate sections of this pipe, respectively.

Moreover, a hole 33 drilled in the downstream part of the body 24 emerges at an intermediate point in the downstream section 32 and is connected, with a sealed joint, by a weld, to a degassing tube 34. The latter (FIG. 1) extends toward the upstream between the tube 20 and the wall 15 of the pipe 16, then in the inter-wall space of the reservoir 8, and terminates in a hook 35 which passes through, with a sealed joint, the upper part of the inner wall 13 and emerges in the latter.

Illustrated in FIG. 2 are the two parts of the horizontal section of the tube 20, which are connected by welds to the two outlets of the duct sections 31 and 32.

The bore 29 and the counterbore 30 are connected by a frustoconical seat 36. The closure member 26 has a frustoconical intermediate part 37 which is conjugate with the seat 36 and provided with a Teflon seal 38, a lower part 39, which is also of frustoconical general shape but with markedly smaller flare angle, and an upper connecting part 40. The latter is connected to the lower end of the rod 27 by a spring clip 41 which allows the closure member to have a slight angular movement about the X—X axis.

At rest, the part 37 of the closure member 26 is pressed against the seat 36 and its lower part 39 is housed with a large clearance in the cavity 30 (in the low position in FIG. 3).

In operation, the closure member is lifted off its seat (in the high position shown in dot-dash lines in FIG. 3), thereby bringing the duct sections 31 and 32 into communication with each other.

The passage of the liquid nitrogen through the central region of the valve body causes a pressure drop, which produces partial vaporization of the liquid (flash). By virtue of the presence of the hole 33 connected to the tube 34 and, beyond that, via the reservoir 8 and the tube 4, to the atmosphere, the flash gas thus produced is immediately removed from the liquid nitrogen and is virtually unable to reach the downstream part of the pipe 16.

It will be understood, on reading the foregoing, that there is great advantage, in this situation of the use of a throttling device (control of the flow rate depending on the position of the device, thereby closing off the passage to a greater or lesser extent, and therefore causing a variation in the pressure drop introduced), in tapping the degassing pipe off the upper part of the main pipe so as to remove, by this means, in a very effective and selective manner, the gas phase formed, which naturally builds up in the upper part of the main pipe, while the cryogenic liquid (consequently substantially freed of gas) flows naturally in the lower part of the main pipe.

The effectiveness of the invention has been demonstrated by the following tests: using the apparatus 4 described above, lifting the closure member by 14% of its maximum travel results in a steady-state situation being established almost instantaneously and in liquid nitrogen flowing, as output, with sufficient regularity for the application in question.

In contrast, with the same apparatus not having the hole 33 and the degassing line 34, the closure member has to be lifted 46% in order to obtain the required liquid nitrogen flow rate, but the flow is irregular; in addition, several minutes are required to establish the steady state.

I claim:

1. Apparatus for delivering a cryogenic liquid comprising a thermally insulated main pipe in which a device for throttling a flow of liquid is mounted, a degassing pipe which is tapped off the upper part of the main pipe downstream of the throttling device so as to separate a gaseous phase from a liquid phase.

2. Apparatus according to claim 1, in which the throttling device is a closure member of a valve which comprises a valve body defining an upstream intermediate section, a downstream intermediate section of the main pipe, a seat located between these two sections, the closure member being mounted so as to move in the valve body with respect to the seat, a hole which emerges in an upper part of the downstream intermediate section and which is connected to the degassing pipe.

3. Apparatus according to claim 1, wherein the degassing pipe extends within an outer wall of the main pipe.

4. Apparatus according to claim 1, further comprising a cryogenic liquid reservoir comprising (1) a bottom from which the main pipe starts, and (2) a upper part from which the degassing pipe emerges.

5. Cryogenic valve comprising a valve body comprising an upstream duct section, a downstream duct section including an upper part a seat located between these two sections, a closure member mounted so as to move in the body with respect to the seat, a hole which emerges in the upper part of the downstream section.

6. Cryogenic valve according to claim 5 wherein the seat is frustoconical and converges downwardly, and is extended downwardly by a cavity and wherein the closure member comprises a frustoconical part, conjugate with the seat and a lower part designed to be housed with a certain clearance in said cavity when the closure member is in a closed position.

7. Plant for packaging a product in containers moving on a conveyor comprising an apparatus for delivering liquid nitrogen according to claim 1, said apparatus being placed above the conveyor for the containers, between a station for filling the containers with the product and a station for sealing the containers.

* * * * *